US008439667B2

(12) United States Patent
Fan et al.

(10) Patent No.: US 8,439,667 B2
(45) Date of Patent: May 14, 2013

(54) OXYGEN TRIM CONTROLLER TUNING DURING COMBUSTION SYSTEM COMMISSIONING

(75) Inventors: Junqiang Fan, Glastonbury, CT (US); Muhidin A. Lelic, Cary, NC (US); Guido Poncia, Glastonbury, CT (US)

(73) Assignee: UTC Fire & Security Corporation, Framington, CT (US)

( * ) Notice: Subject to any disclaimer, the term of this patent is extended or adjusted under 35 U.S.C. 154(b) by 0 days.

(21) Appl. No.: 13/127,360

(22) PCT Filed: Nov. 25, 2008

(86) PCT No.: PCT/US2008/004700

§ 371 (c)(1), (2), (4) Date: May 3, 2011

(87) PCT Pub. No.: WO2010/062287

PCT Pub. Date: Jun. 3, 2010

(65) Prior Publication Data

US 2011/0223548 A1 Sep. 15, 2011

(51) Int. Cl.
*F23N 1/02* (2006.01)

(52) U.S. Cl.
USPC ..... 431/12; 431/2; 431/6; 431/18; 700/274; 700/289

(58) Field of Classification Search ..... 431/2, 6, 431/12, 18; 700/274, 289
See application file for complete search history.

(56) References Cited

U.S. PATENT DOCUMENTS

| | | | | | |
|---|---|---|---|---|---|
| 3,369,749 | A | * | 2/1968 | Siegmund et al. | 431/12 |
| 4,133,629 | A | | 1/1979 | Clark | |
| 4,157,238 | A | * | 6/1979 | van Berkum | 431/12 |
| 4,162,889 | A | * | 7/1979 | Shigemura | 431/76 |
| 4,249,886 | A | * | 2/1981 | Bush | 431/90 |
| 4,264,297 | A | * | 4/1981 | Van Berkum | 431/76 |
| 4,330,261 | A | * | 5/1982 | Sun | 431/14 |
| 4,408,569 | A | * | 10/1983 | Novak | 122/448.1 |
| 4,474,549 | A | | 10/1984 | Capone | |
| 4,489,375 | A | * | 12/1984 | Putman | 700/37 |
| 4,489,376 | A | * | 12/1984 | Putman | 700/45 |
| 4,492,559 | A | * | 1/1985 | Pocock | 431/12 |
| 4,498,863 | A | * | 2/1985 | Hanson et al. | 431/89 |
| 4,500,950 | A | * | 2/1985 | Putman | 700/9 |
| 4,509,912 | A | | 4/1985 | VanBerkum | |
| 4,516,929 | A | * | 5/1985 | Hiroi et al. | 431/12 |
| 4,531,905 | A | | 7/1985 | Ross | |
| 4,586,893 | A | | 5/1986 | Somerville et al. | |
| 4,622,922 | A | * | 11/1986 | Miyagaki et al. | 122/449 |
| 4,645,450 | A | | 2/1987 | West | |
| 4,676,734 | A | | 6/1987 | Foley | |
| 4,698,015 | A | * | 10/1987 | Brunel | 431/76 |
| 4,717,071 | A | * | 1/1988 | Capone | 236/15 E |
| 4,836,166 | A | | 6/1989 | Wietelmann | |
| 4,903,656 | A | * | 2/1990 | Nakazono et al. | 123/259 |

(Continued)

FOREIGN PATENT DOCUMENTS

JP 62238921 10/1987

*Primary Examiner* — Kenneth Rinehart
*Assistant Examiner* — Jorge Pereiro
(74) *Attorney, Agent, or Firm* — Cantor Colburn LLP

(57) ABSTRACT

A method is provided for tuning an oxygen trim controller during the commissioning of a combustion control system for controlling operation of a boiler combustion system, rather than tuning the oxygen trim controller after the commissioning process has been completed.

5 Claims, 6 Drawing Sheets

U.S. PATENT DOCUMENTS 4,927,350 A * 5/1990 Zabielski ..... 431/12
5,099,442 A * 3/1992 Furuta et al. ..... 700/274
5,120,214 A * 6/1992 West et al. ..... 431/12
5,126,933 A * 6/1992 White, III ..... 700/47
5,310,335 A 5/1994 van Berkum
5,369,567 A * 11/1994 Furuta et al. ..... 700/29
5,880,411 A 3/1999 Gillespie et al.
6,024,561 A 2/2000 Kemp et al.
6,206,687 B1 3/2001 Redington
6,207,936 B1 * 3/2001 de Waard et al. ..... 219/497
6,247,919 B1 6/2001 Welz, Jr. et al.
6,371,752 B1 * 4/2002 Kuroda et al. ..... 431/6
6,373,033 B1 * 4/2002 de Waard et al. ..... 219/497
6,918,356 B2 7/2005 Rowe et al.
7,152,001 B2 * 12/2006 Aughton et al. ..... 702/2
7,335,015 B2 * 2/2008 Meier ..... 431/10
2003/0054308 A1 3/2003 Abbasi et al.
2009/0018675 A1 * 1/2009 Sesay ..... 700/17
2009/0105852 A1 * 4/2009 Wintrich et al. ..... 700/29
2009/0142717 A1 6/2009 Lavelle

* cited by examiner

OXYGEN TRIM CONTROLLER TUNING DURING COMBUSTION SYSTEM COMMISSIONING

CROSS REFERENCE TO RELATED APPLICATION

This application is related to International (PCT) Patent Application Serial No. PCT/US2008/054393, filed May 20, 2008, and entitled ASSISTED COMMISSIONING METHOD FOR COMBUSTION CONTROL SYSTEMS, which application is incorporated herein in its entirety by reference.

FIELD OF THE INVENTION

This invention relates generally to natural gas and oil fired boilers and, more particularly, to the commissioning process for combustion control systems for industrial and commercial natural gas and oil fired, steam/hot water boilers.

BACKGROUND OF THE INVENTION

Combustion controllers are commonly employed in connection with industrial and commercial boilers for modulating air flow and fuel flow to the burner or burners of the boiler. One type of combustion controller uses parallel positioning of air flow and fuel flow actuators to modulate air flow and fuel flow over the entire operating range of the boiler to ensure the safety, efficiency, and environmental requirements of combustion can be satisfied across the entire operating range. In parallel positioning control systems, the combustion controller controls air flow by manipulating actuators associated with a set of air dampers and/or a variable frequency driver operatively associated with a variable speed air flow fan. The combustion controller also independently controls fuel flow by manipulating fuel actuators, such as solenoid valves or other types of flow servo valves, to increase or decrease fuel flow to match the desired firing rate.

The operating range of a boiler is generally defined by its firing range between a low fire point commensurate with the minimum firing rate at which combustion is sustainable and a high fire point commensurate with the maximum energy output of the burner. The firing range depends on the boiler's burner's turndown ratio, that is, the ratio between the highest energy output and the lowest energy output. For each given firing rate within the boiler firing range a pair of suitable positions of the air supply and fuel supply actuators must be defined. Each pair of actuator positions then corresponds to a defined air/fuel ratio that in turns determines efficiency, emissions and stability of combustion for a resultant firing rate. The determined set of coordinated air and fuel actuator positions provides a map or algorithm that is used by the boiler controller during operation of the boiler to modulate the burner fuel valve and the air damper in response to firing rate.

When a combustion control system is first installed on a boiler, the desired air and fuel actuator positions need to be defined at a number of points, i.e. firing rates, within the firing range, because the relationship between the sets of air and fuel actuator positions to firing rate is non-linear. The process of defining the proper fuel and air actuator positions throughout the firing range is commonly referred to as commissioning of the boiler combustion control system. The purpose of the commissioning process is to find a set of coordinated air and fuel actuator positions at various points, i.e. firing rates, across the operating range such that safety, efficiency, and environmental requirements can be achieved. During the commissioning process, at each of the respective firing rates at which an optimal set coordinated air and fuel actuator positions is determined, the excess oxygen level associated with combustion at those positions is measured and recorded.

Generally, in parallel positioning combustion control, the combustion controller includes a first feedback circuit including a pressure controller for adjusting the firing rate in response to a sensed boiler pressure and a second feedback circuit including an oxygen trim controller for adjusting the excess oxygen level in response to a sensed excess oxygen in the flue gas. Typically, the pressure controller and the oxygen trim controller are of the type commonly referred to PID controllers. Such controllers employ a control function having a proportional term, an integral term and a differential term. In conventional practice, once the commissioning process is completed, it is necessary for the commissioning technician to separately tune the oxygen trim controller and the pressure controller through a trial and error method or step tests. The purpose of the tuning process is to establish the gain factors associated with the proportional, integral and differential terms of the control function to provide a control function that is applicable over the entire firing range of the associated combustion system. The tuning of both controllers after completion of the commissioning process lengthens the time required for a technician to complete installation of the combustion control system.

SUMMARY OF THE INVENTION

A method is provided for tuning an oxygen trim controller during a commissioning process of a combustion control system for controlling operation of a boiler combustion system discharging a flue gas and having a fuel flow control device operatively associated with a burner and an air flow control device operatively associated with the burner. The method includes the steps of:

(a) at a first selected firing rate selecting one of either the servo position of the fuel flow control device or the servo position of the air flow control associated with the selected firing rate point;

(b) defining an excess oxygen content target value for the selected firing rate point;

(c) varying the servo position of the other of the air flow control device or the fuel flow control device until a measured steady-state value of the excess oxygen content in the flue gas falls within a predefined range of a preselected excess oxygen target value associated with the first selected firing rate, thereby establishing a first coordinated set of a first air servo position and a first fuel servo position;

(d) measuring the excess oxygen content in the flue gas while varying the servo position during step (c);

(e) establishing a transfer function model for the relationship between excess oxygen content and the first selected firing rate based on the measured excess oxygen contents and the corresponding servo positions from step (d);

(f) repeating steps (a) through (e) for a plurality of selected firing rates; and (g) saving the transfer function models associated with each respective firing rate of the plurality of selected firing rates.

(h). calculating the proportional, integral, derivative parameters of the oxygen trim controller based on the model functions from step (g).

In an embodiment, the method further includes the step of determining an average transfer function model over at least two of the plurality of the selected firing rates representative of the plurality of transfer function models associated with the at least two of the plurality of the selected firing rates. The method may also include the further step of using the average transfer function model to calculate a proportional parameter gain factor for the oxygen trim controller. The method may also include the further step of using the average transfer function model to calculate an integral parameter gain factor for the oxygen trim controller.

BRIEF DESCRIPTION OF THE DRAWINGS

For a further understanding of the invention, reference will be made to the following detailed description of the invention which is to be read in connection with the accompanying drawing, wherein.

DETAILED DESCRIPTION OF THE INVENTION

Figure 1:
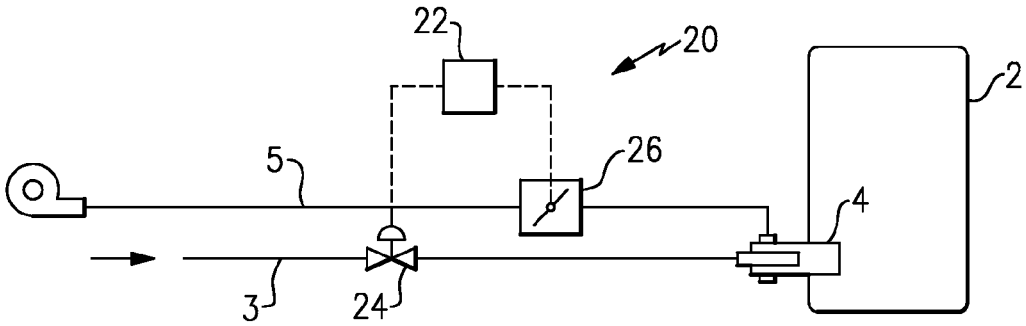
FIG. 1 is a schematic diagram of a combustion system for a steam/hot water boiler.

Referring now to FIG. 1, there is depicted a block diagram representing a parallel positioning combustion control system 20 for controlling fuel flow and air flow to a burner 4 of a hot water or steam boiler 2. The combustion control system 20 includes a fuel flow control device 24, typically a servo-valve, disposed in a fuel supply line 3 to the burner 4 to control the amount of flow supplied to the burner. The combustion control system 20 also includes an air flow control device 26, such as, for example, a damper disposed in an air supply duct 5 to the burner 4, to control the amount of airflow supplied to the burner. The combustion control system 20 further includes a controller 22 operatively associated with the fuel flow control device 24 for selectively manipulating the fuel flow control device 24 and with the air flow control device 26 for selectively manipulating the air flow control device 26. In operation, the control system 20 functions to maintain safe, efficient and environmental acceptable operation at any particular firing rate.

Figure 2:
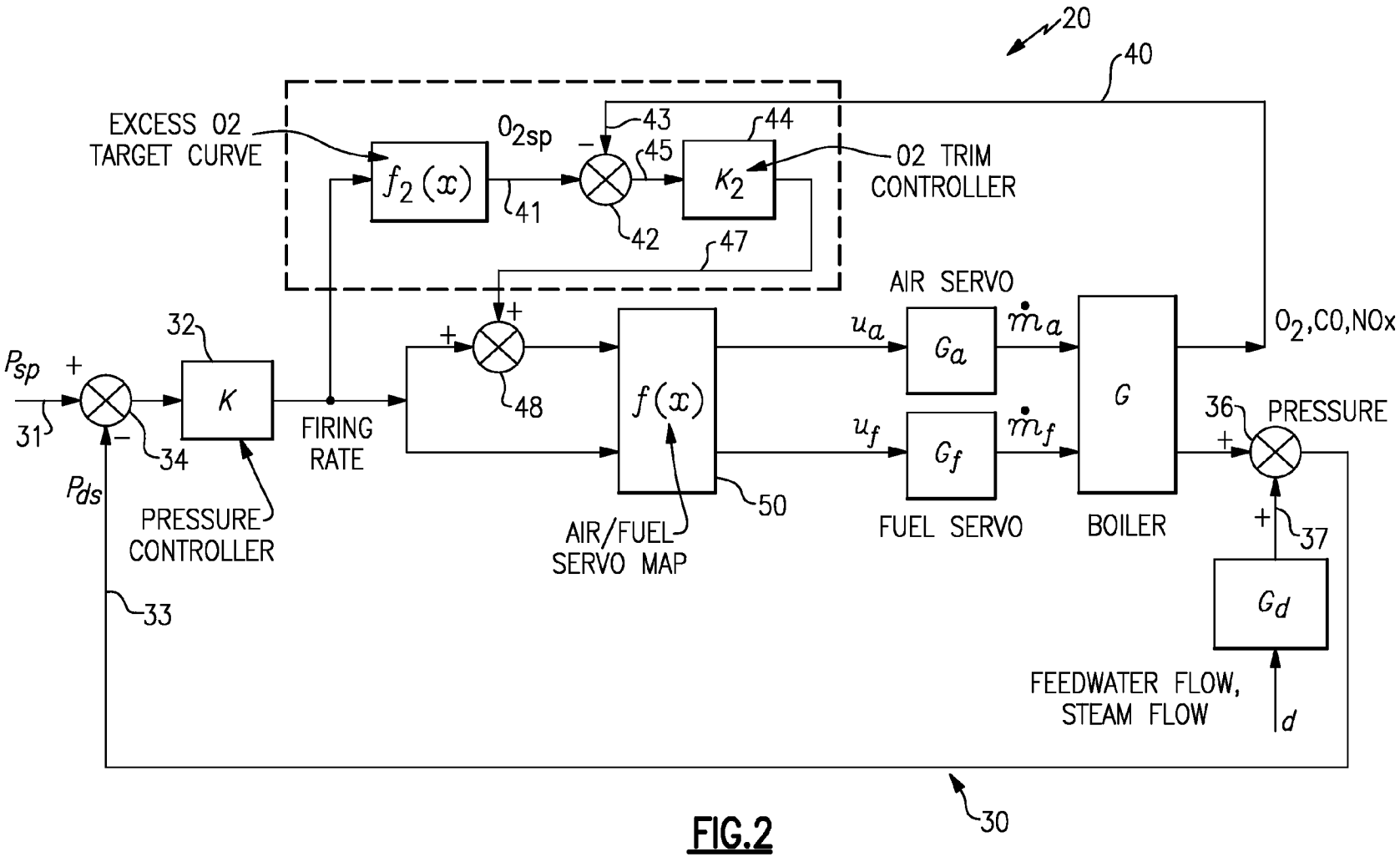
FIG. 2 is a block diagram of an exemplary embodiment of a parallel positioning combustion control system with oxygen trim control.

Referring now to FIG. 2, the combustion control system 20 depicted therein is exemplary of a conventional dynamic feedback control having a boiler steam pressure (or hot water temperature for a hot water boiler) control feedback loop 30, an oxygen level control feedback loop 40, and a fuel/air servo map 50. In FIG. 2, $\dot{m}_a$ represents the air mass flow rate and $\dot{m}_f$ represents the fuel mass flow rate. $G_a$ represents the air servo transfer function, $G_f$ represents the fuel servo transfer function, G represents the boiler transfer function, and $G_d$ represents the boiler water-side disturbance transfer function. Additionally, $f_2(x)$ represents an excess oxygen target curve, which is a load dependent (nonlinear) function relating set point oxygen content target values to firing rate.

The air servo transfer function, $G_a$, converts an air servo position, $u_a$, inputted to the air flow control device 26 to a corresponding air mass flow rate, $\dot{m}_a$. The fuel servo transfer functions, $G_f$, coverts a fuel servo function, $u_f$, inputted to the fuel flow control device 24 to a corresponding fuel mass flow rate, $\dot{m}_f$. The boiler transfer function, G, models the boiler fire-side operation and provides as output, a boiler steam pressure and flue gas excess oxygen content for an inputted fuel mass flow rate and an inputted air mass flow rate. The boiler water-side transfer function, $G_d$, translates an input change in a boiler water-side parameter, such as boiler water level, feed water mass flow rate, and/or steam (hot water) mass flow rate into a boiler pressure change.

The boiler feedback loop 30 includes a boiler pressure controller 32 that adjusts the burner firing rate in response to a change in one or more operating parameters impacting boiler steam pressure (hot water temperature) in order to maintain a desired set point pressure. The boiler pressure controller 32 receives as input a signal indicative of the change in the boiler steam pressure (hot water temperature) from a negative feedback circuit 34 attendant to a change in one or more water-side operating parameters, such as boiler water level, boiler feedwater mass flow rate, and boiler steam (hot water) mass flow rate, or a change in a fire-side operating parameter, such as fuel mass flow rate or air mass flow rate, reflected in a signal output from the addition circuit 36.

The controller 22 determines an adjusted firing rate as needed to maintain boiler load at the set point boiler pressure and uses that adjusted firing rate in controlling the fuel flow control device 24. The controller 22 selects the desired fuel servo position, $u_f$, associated with that firing rate from reference to the air/fuel servo map 50 programmed into the controller and repositions the fuel flow control 24 to the desired fuel servo position, $u_f$, which changes the fuel mass flow rate to the burner 24.

The controller 22 also uses the adjusted firing rate in controlling the air flow control device 26. If the controls system 20 includes an oxygen trim control feedback loop 40, as in the exemplary embodiment depicted in FIG. 2, the adjusted firing rate used by the controller 22 in selecting the desired fuel servo position, $u_f$, is further adjusted at an addition circuit 48 in response to an oxygen trim signal 47. An oxygen trim controller 44 generates the oxygen trim signal 47 based upon an error signal 45, for example by applying a PID function to the error signal 45. The error signal 45 is output from the negative feedback circuit 42 which receives as input a signal 43 indicative of the sensed excess oxygen content and a signal 41 indicative of a set point excess oxygen content for the adjusted firing rate selected by the controller 22 via reference to the excess oxygen target curve, $f_2$ (x), which as noted previously is a function of firing rate.

The controller 22 references the air/fuel servo map 50 programmed into the controller to select the air servo position, $u_a$, associated with the further adjusted firing rate, if the control system 20 includes an oxygen trim control feedback loop, or simply the adjusted firing rate, if no oxygen trim control feedback loop is included. The controller 22 then repositions the air flow control 26 to the selected air servo position, $u_a$, which changes the air mass flow rate to the burner 24.

Figure 3:
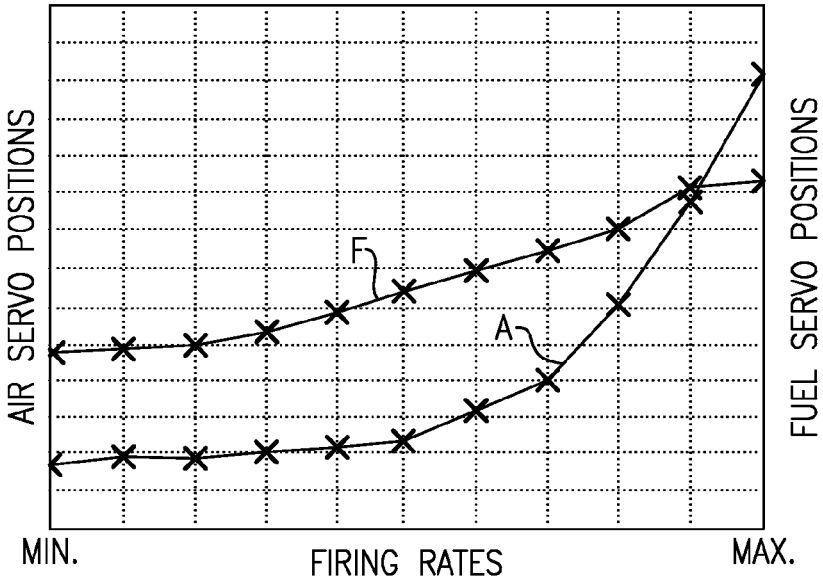
FIG. 3 is a graphical illustration of a map of an exemplary set of coordinated fuel servo and air servo positions versus firing rate.

Referring now to FIG. 3, the air/fuel servo map 50 comprises a set of coordinated positions representing the respective desired actuator positions for the fuel flow control device 24, curve F, and the air fuel flow control device 26, curve A, at each of a continuum of firing rates from the low firing point to the high firing point. The non-linear curves A and F which make up the air/fuel servo map 50 must be developed via a process known as commissioning when the technician installs the combustion control system 20 on the boiler. As noted previously, in conventional practice, the technician conducts the commissioning of the combustion control system using a trial and error process. In the method of the invention for commissioning the combustion control system 20, the trial and error process is eliminated through an iterative mapping process that uses an algorithm to estimate the optimum servo positions for one of the fuel flow control device 24 and the air flow control device 26 at any set servo position of the other.

One pair of coordinated actuator positions for each firing rate is found through setting the servo position of one of either the fuel flow control device or the air flow control device and manipulating the other of the fuel flow control device 24 or the air flow control device 26 for adjusting either the fuel flow or the air flow to the burner such that the amount of excess oxygen in the exhaust stack is maintained at the target excess oxygen level. Typically, the target excess oxygen level represents the combustion conditions at which the concentrations of carbon monoxide and other undesirable emissions, such as oxides of nitrogen, are kept at minimum level. In an embodiment of the method of the invention, the mapping process is conducted with first selecting the fuel flow control servo positions for the selected firing rates and then applying the method of the invention to determine the optimum air flow control servo position at each of the selected firing rates. In another embodiment of the method of the invention, the mapping process is conducted with first selecting the air flow control servo positions for the selected firing rates and then applying the method of the invention to determine the optimum fuel flow control servo position at each of the selected firing rates.

To commission the combustion control system 20, the technician performing the commissioning task needs to manually define the optimal fuel servo position, i.e. the position of the fuel flow control device 24, and the optimal air servo position, i.e. the position of the air flow control device 26, for the ignition point and the low firing rate as in conventional practice. After defining the fuel servo position and the air servo position for the ignition point and the low firing point, rather than proceeding by the conventional trial and error process, in the method of the invention for commissioning the combustion control system 20 an algorithm is used to assist in identifying a series of coordinated fuel and air actuator positions for a plurality of firing rate points over the entire operating range.

Figures 4, 4A:
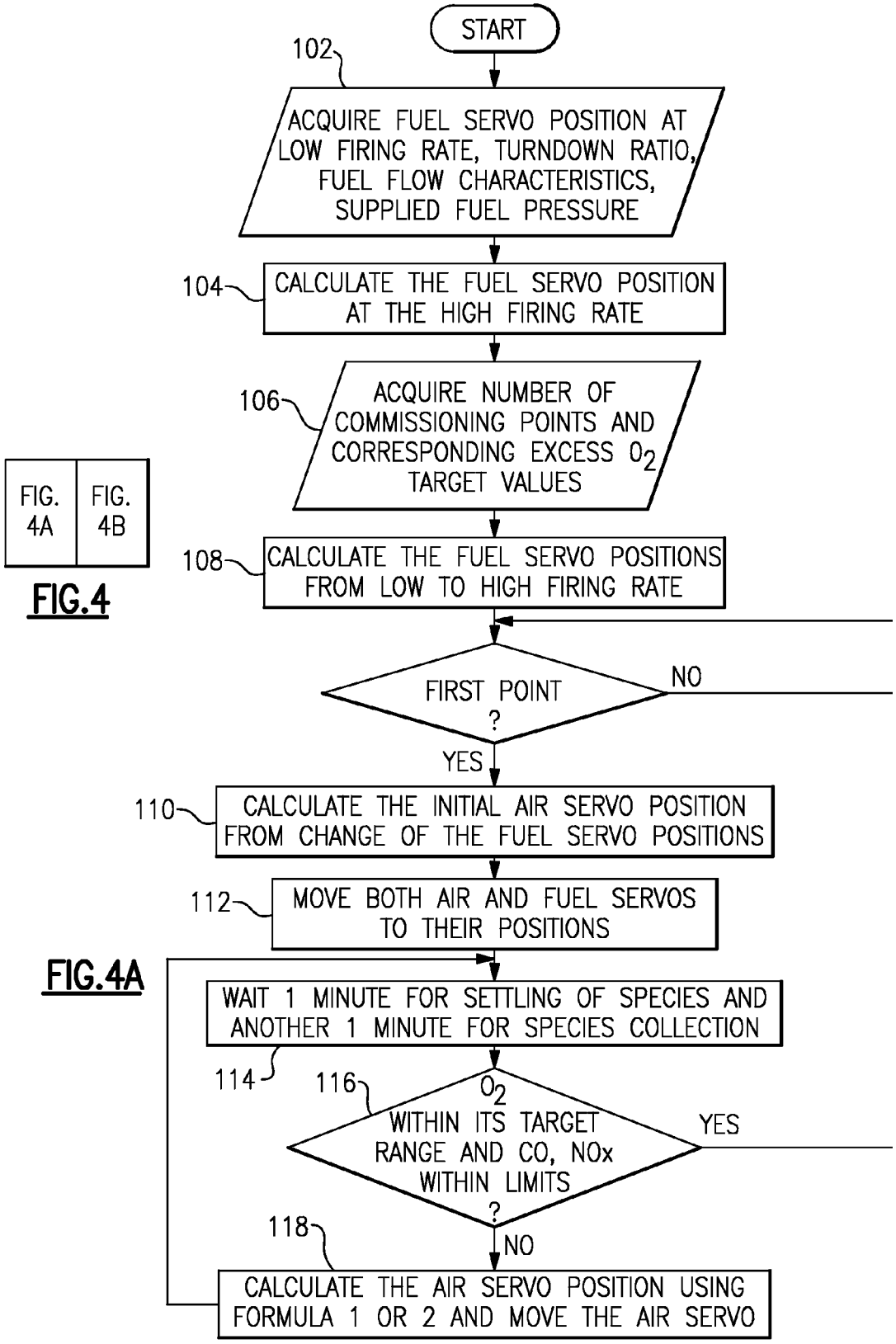
FIG. 4 is a process flow diagram illustrating an exemplary embodiment of a commissioning process of the combustion control system of FIG. 2.
Figure 4B:
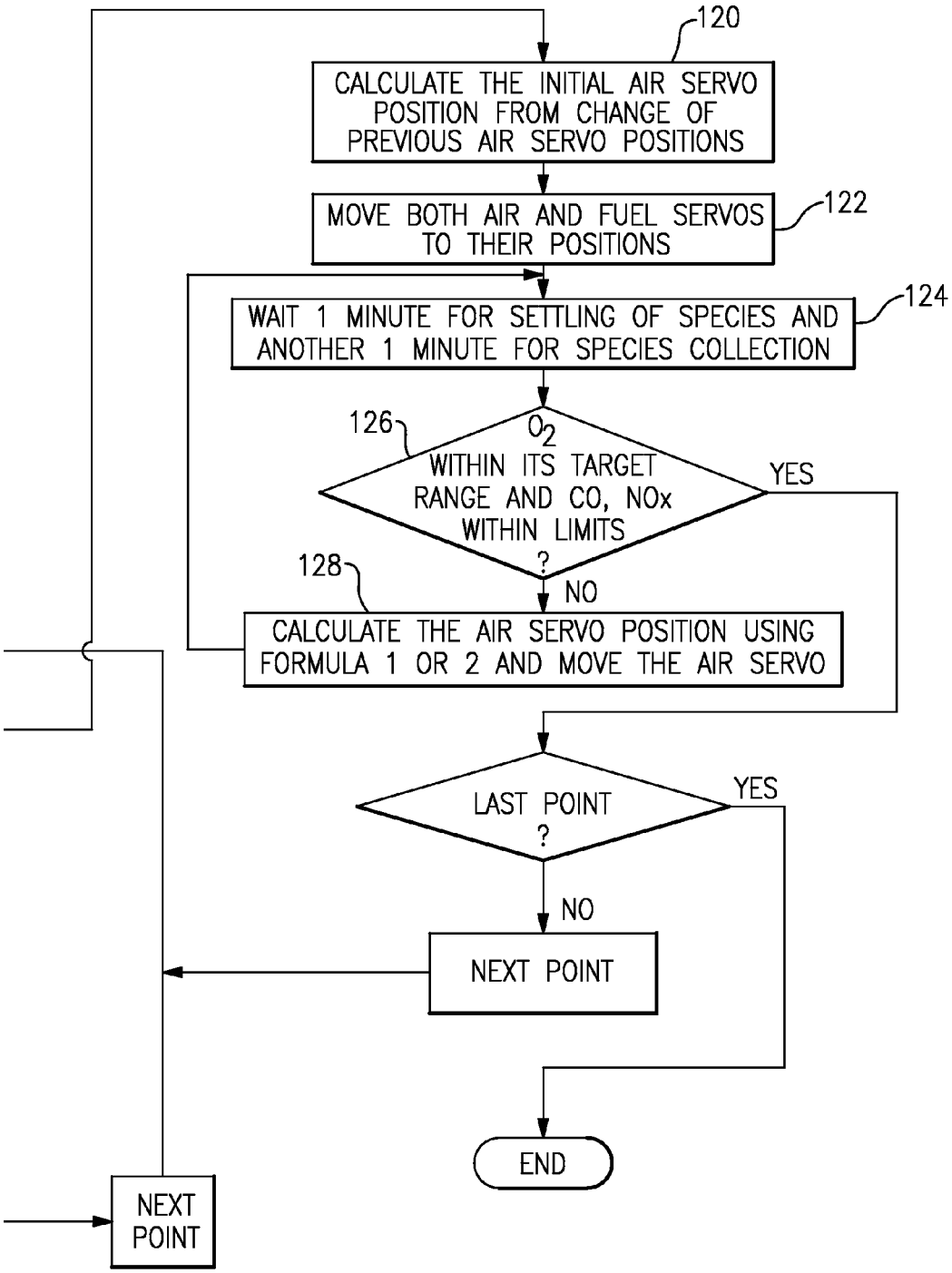

The method of the invention will be described hereinafter with reference to an exemplary embodiment wherein the air servo position is iterated upon for each firing rate at a set fuel servo position associated with the firing rate. Referring now the FIG. 4, there is presented a block diagram illustrating an exemplary application of an exemplary algorithm in accord with the assisted commissioning method of the invention. As a first step, designated as 102, in applying the assisted commissioning method of the invention, the controller 22 acquires the fuel servo position at low firing rate, the burner turndown ratio, the fuel flow characteristics, and the supplied fuel pressure. Using this acquired information, the controller 22 next, at step 104, calculates the fuel servo position at the high firing rate. At step 106, the controller 22 acquires the preselected number of commissioning points, that is, firing rates between the low firing rate and the high firing rate at which the coordinated fuel and air servo positions are to be determined, and the excess oxygen target values for each of those selected firing rate points from a preset look-up table.

At step 108, the controller 22 calculates the fuel servo position associated with each of the selected firing rate points from low to high firing rate. If the fuel flow characteristic versus servo position for the fuel flow control device 24 is relatively linear between the low firing rate and the high firing rate, the fuel servo positions are selected at evenly spaced increments of fuel servo position between the fuel servo position at the low firing rate and the fuel servo position at the high firing to correspond to an equal number of firing rates. However, if the fuel flow characteristic versus servo position for the fuel flow control device 24 is severely non-linear between the low firing rate and the high firing rate, the fuel servo positions are selected at evenly spaced increments of fuel flow between the minimum fuel flow at the low firing rate and the maximum fuel flow at the high firing to correspond to an equal number of firing rates.

For the first point at which commissioning is to occur, which is the first firing rate point of the selected points next greater than the low firing rate point, for example a firing rate in the vicinity of 3% of the maximum firing rate, the controller at step 110 calculates an initial air servo position for the first selected commissioning firing rate based on the change of the fuel servo positions between the first selected commissioning firing rate and the low firing rate. Next, at step 112, the controller 22 sets the fuel flow control device 24 according to the fuel servo position associated with that firing rate point as determined at step 108, and sets the air flow control device 26 according to the air servo position associated with that firing rate point as determined in step 110. After waiting a preselected period of time, such as for example about 1 minute for settling of combustion species (CO, excess $O_2$, NOx), a sampling of the combustion flue gases is obtained at step 114. Allowing a short period of time for species collection, such as for example another minute, the controller 22 next, at step 116, verifies whether the excess oxygen content is within an acceptable range of its target valve and whether the sensed CO and NOx emissions are within acceptable limits.

If the excess oxygen content is not within its target range and/or the CO or NOx emissions is not within acceptable limits, the controller 22 calculates, at step 118, a new servo position for the air flow control device 26 using one of the following two formulas:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the air servo position at the previous firing rate and $v_b$ denotes the initial air servo position at the current firing rate, $\delta$ denotes the firing rate change between the current firing rate and the previous one, $O_2^t$, $O_2^a$, and $O_2^b$ represent the target excess oxygen content value, the measured excess oxygen content values at the servo positions $v_a$ and $v_b$, respectively. The first of the formulae is generally applied when the fuel flow control servo position at the second firing rate is different from the fuel flow control servo position at the first firing rate. The second of the formulae is generally applied when the fuel flow control servo position at the second firing rate is not changed.

Having calculated the new air servo position, the controller 22 returns to step 112 and moves the air flow control device 26 to the position associated with the new air servo position and again performs steps 112 through 118 repeatedly until the excess oxygen content is within an acceptable range of its target valve and the sensed CO and NOx emissions are within acceptable limits, or until a preselected maximum number of iterations has been performed.

When the excess oxygen content is within an acceptable range of its target valve and the sensed CO and NOx emissions are within acceptable limits, or after a preselected maximum number of iterations have been performed, the controller 22 proceeds to the next greater commissioning firing rate of the selected number of commissioning firing rates and, at step 120, calculates an initial air servo position for the next selected commissioning firing rate based on the change between the air servo positions associated with the two previous firing rates, that is the change between the determined air servo positions associated with the first commissioning firing the low firing rate or between the air servo positions associated with the two most previous commissioning firing rate points, as the case may be. Next, at step 122, the controller 22 sets the fuel flow control device 24 according to the fuel servo position associated with that firing rate point as determined at step 108, and sets the air flow control device 26 according to the air servo position associated with that firing rate point as determined in step 120. After waiting a preselected period of time, such as for example about 1 minute for settling of combustion species (CO, excess $O_2$, NOx), a sampling of the combustion flue gases is obtained at step 124. Allowing a short period of time for species collection, such as for example another minute, the controller 22 next, at step 126, verifies whether the excess oxygen content is within an acceptable range of its target valve and whether the sensed CO and NOx emissions are within acceptable limits.

If the excess oxygen content is not within its target range and/or the CO or NOx emissions is not within acceptable limits, the controller 22 calculates, at step 128, a new servo position for the air flow control device 26 using one of the following two formulas:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the air servo position at the previous firing rate and $v_b$ denotes the initial air servo position at the current firing rate, δ denotes the firing rate change between the current firing rate and the previous one, $O_2^t$, $O_2^a$, and $O_2^b$ represent the target excess oxygen content value, the measured excess oxygen content value at the servo positions $v_a$ and $v_b$, respectively. As noted previously, the first of the formulae is generally applied when the fuel flow control servo position at the second firing rate is different from the fuel flow control servo position at the first firing rate. The second of the formulae is generally applied when the fuel flow control servo position at the second firing rate is not changed.

Having calculated the new air servo position, the controller 22 returns to step 122 and moves the air flow control device 26 to the position associated with the new air servo position and again performs steps 122 through 128 repeatedly until the excess oxygen content is within an acceptable range of its target valve and the sensed CO and NOx emissions are within acceptable limits, or until a preselected maximum number of iterations was been performed.

When the excess oxygen content is within an acceptable range of its target valve and the sensed CO and NOx emissions are within acceptable limits, or after a preselected maximum number of iterations have been performed, the controller 22 proceeds to the next greater commissioning firing rate of the selected number of commissioning firing rates and repeats steps 120 through 128 until the coordinated fuel and air servo positions have been determined for the last of the selected commissioning firing rates, at which point the commissioning process has been completed.

Figure 5A:
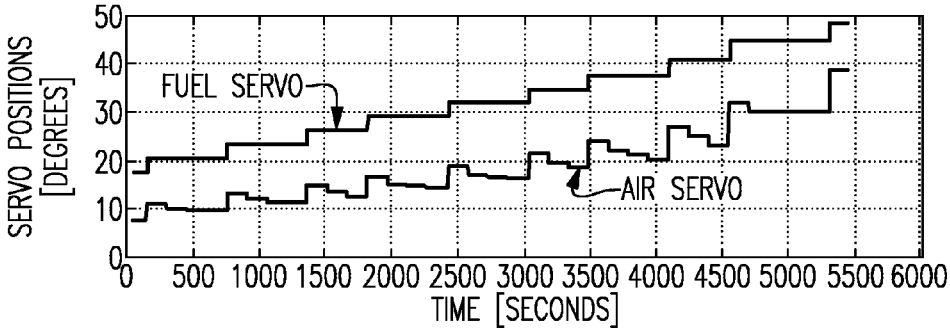
FIG. 5*a* is a graph illustrating the development of the optimal air servo position associated with the fuel servo position at various selected firing rates over time during the commissioning process.
Figure 5B:
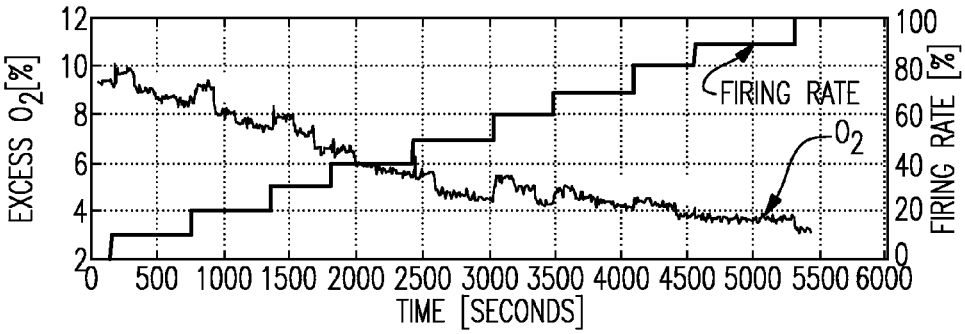
FIG. 5*b* is graph illustrating the variation of the excess oxygen content as measured in the flue gas and the change in firing rate over time during the commissioning process.

The coordinated sets of fuel flow control servo position and air flow control servo position developed at the various selected firing rates between the minimum firing rate and the maximum firing rate, illustrated in FIG. 5*a*, are stored in a memory bank operatively associated with the controller 22. Additionally, the excess oxygen content levels measured in the flue gas at various air servo positions at each of the selected firing rates between the minimum firing rate and the maximum firing rate, illustrated in FIG. 5*b*, are stored in a memory bank operatively associated with the controller 22.

Figure 6:
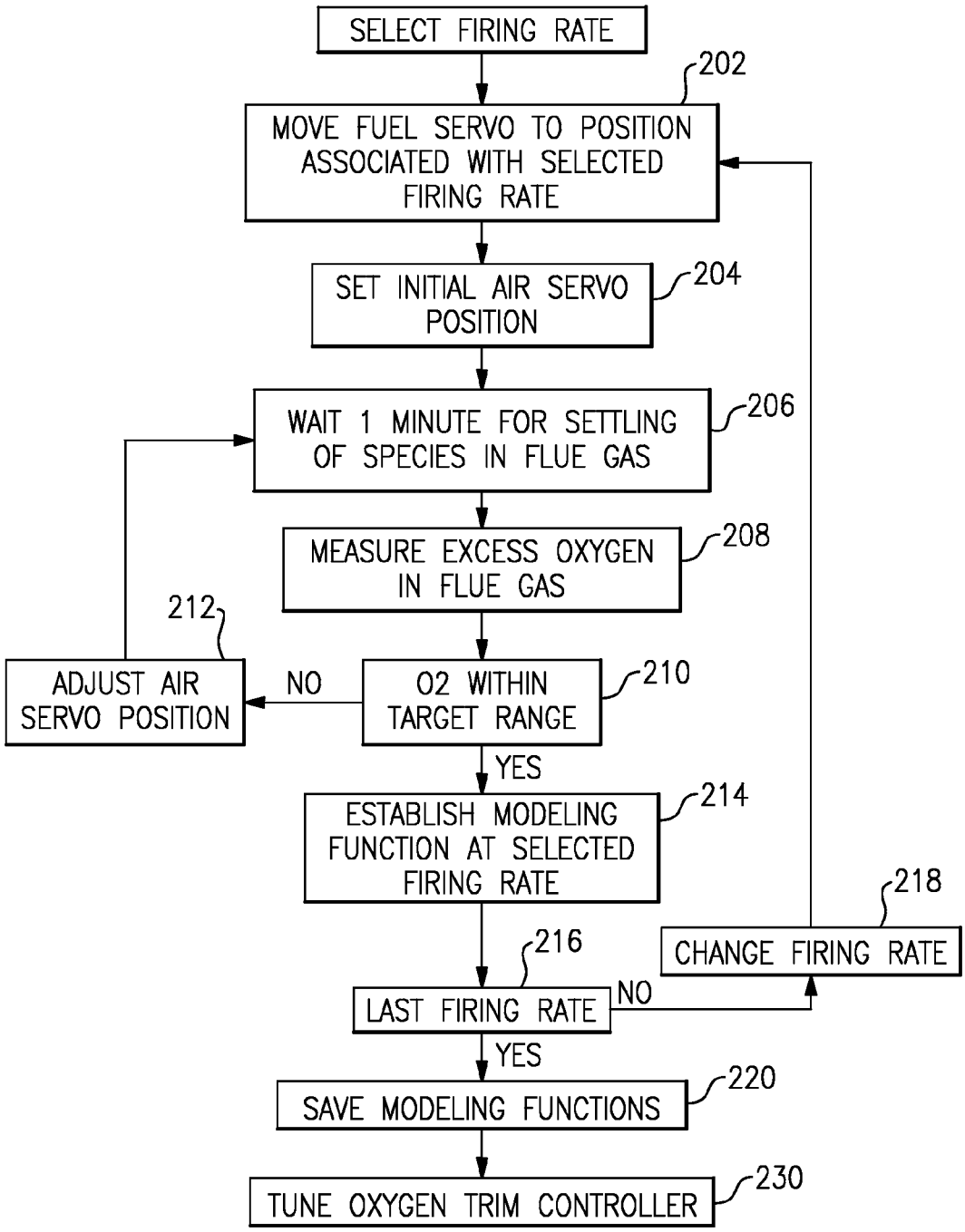
FIG. 6 is a process flow diagram illustrating an exemplary embodiment of a method of tuning an oxygen trim controller as disclosed herein.

The tuning of the oxygen trim controller 44, in accordance with the method disclosed herein, occurs during the course of the commissioning process rather than after the commissioning process is completed. At each selected firing rate at which a set of coordinated fuel servo and air servo positions are determined during the commissioning process, a function is developed at each selected firing rate by the controller 22 that models the change in excess oxygen content as measured in the flue gas over time as the air servo position is varied in the search for the optimal air servo position associated with the fuel servo position at the selected firing rate. Referring now to FIG. 6, in connection with the commissioning process described hereinbefore, at the first selected firing rate, at step 202, the fuel servo is positioned in a selected position associated with the selected firing rate and then at step 204, the air servo is positioned in a selected initial position. After a time delay at step 206, for example a delay of one minute, to allow the combustion process to reach steady-state so that species in the flue gas settle to a steady-state value, the excess oxygen level in the flue gas is measured at step 208 and the resulting measurement stored in the controller 22. At step 210, the measured excess oxygen content is compared to a preselected range around an acceptable excess oxygen content target level. If the measured excess content is outside the target range, the position of the air servo is varied and steps 206 through 212 are repeated until the measured excess oxygen content in the flue gas falls within a predefined range of a preselected excess oxygen target valve associated with the first selected firing rate, thereby establishing a first coordinated set of a first air servo position and a first fuel servo position. The excess oxygen content in the flue gas is measured when the air servo position is varied at the first selected firing rate during the commissioning process. When the controller 22 has received all of the excess oxygen content measurements at the selected firing rate, the controller 22, at step 214, establishes a function modeling the relationship between excess oxygen content measurements and the first selected firing rate based on those measurements. At step 216, if the last firing rate in the firing range has not yet been processed, the controller 22 at step 218 changes the firing rate to the next selected firing rate. The controller 22 repeats steps 202 through 214 at each of the selected firing rates used during the commissioning process, establishing a transfer function model at each selected firing rate. Once the coordinated set of fuel servo and air servo positions has been established at the last selected firing rate, the controller 22 at step 220 stores the plurality of transfer function models. At step 230, the controller 22 uses the plurality of transfer function models established at the various firing rates during the commissioning process to tune the oxygen trim controller 44.

Figure 7:
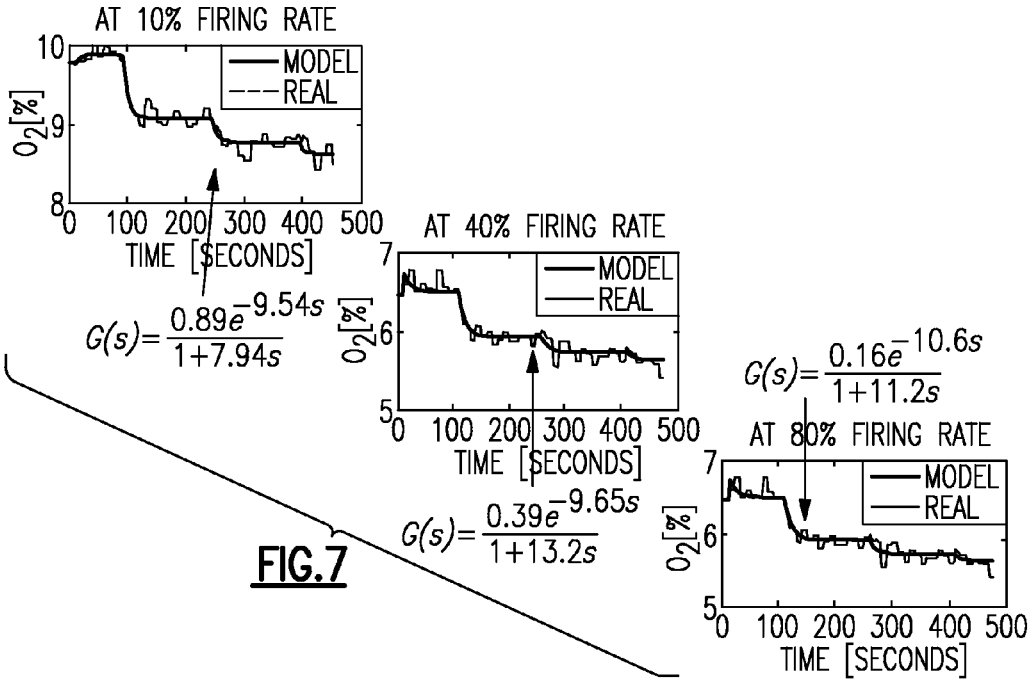
FIG. 7 is a series of three graphs illustrating the development of transfer function models from the excess oxygen content measurements taken during the commissioning process at three selected firing rates.

Referring now to FIG. 7, there are depicted three graphs depicting the variation of the excess oxygen content as measured in the flue gas over time as the air servo position was varied at each of three exemplary firing rates. For purposes of illustration, the firing rates of 10%, 40% and 80% of the maximum firing rate for the combustion system 20 were selected for presentation. At each firing rate, the controller 22 fits a functional relationship to the measured valves. In an embodiment, the functional relationship may be of the form:

$$G(s)=Ae^{-Bs}/(1+Cs);$$

where A is a gain factor constant, B is a time delay, C is a time constant, and s is the Laplace variable, after the beginning of operation at a given firing rate at the coordinated set of fuel servo position and air servo position at that firing rate. However, it is to be understood that in applying the tuning method disclosed herein, the transfer function model employed may take other forms.

For example, at 10% firing rate, the plant's transfer function G(s) for the oxygen trim controller may be represented by the functional relationship:

$$G(s)=0.89e^{-9.54s}/(1+7.94s);$$

at 40% firing rate, the plant's transfer function G(s) for the oxygen trim controller may be represented by the functional relationship:

$$G(s)=0.39e^{-9.65s}/(1+13.2s); \text{ and}$$

at 80% firing rate, the plant's transfer function G(s) for the oxygen trim controller may be represented by the functional relationship:

$$G(s)=0.16e^{-10.6s}(1+11.2s);$$

These functional relationships are merely exemplary and are presented solely for purposes of illustration and are not to be considered limiting of the mathematical form that any particular functional relationship may take.

Having defined a transfer function model at each of the selected firing rates during the commissioning process, the controller 22 uses the plurality of transfer function models to tune the oxygen trim controller 44. If the respective gain factor constants, the time constants and time delay constants of all or a portion of the plurality of transfer function models are of similar order of magnitude, the controller 22 will calculate an average gain factor constant and an average time constant and select the largest time delay constant in developing a single average transfer function model applicable over the entire firing range or at least a relatively larger portion of the firing range representing a plurality of firing rates. In an embodiment, the method may include the step of determining an average transfer function model over the plurality of the selected firing rates representative of the plurality of transfer function models associated with the plurality of the selected firing rates over the entire firing range. In an embodiment, the method may include the step of determining an average transfer function model over at least two of the plurality of the selected firing rates representative of the plurality of transfer function models associated with the at least two of the plurality of the selected firing rates. The latter approach may be used when the transfer function models at very different firing rates exhibit very different gain factor constants or time constants and it is desirable to break the firing range down into two or more segments and define a series of average transfer function models, one for each of the firing range segments, rather than attempting to define a single average transfer function model applicable at all firing rates over the entire firing range.

In an embodiment of the combustion control system 20, the oxygen controller 44 may be a proportional-integral-differential (PID) type controller. In such case, the tuning method includes the further step of using a single average transfer function model to calculate a proportional parameter gain factor for the oxygen trim controller applicable over the entire firing range or a segment of the firing range. In such case, the tuning method includes the further step of using a single average transfer function model to calculate an integral parameter gain factor for the oxygen trim controller applicable over the entire firing range or a segment of the firing range.

The assisted commissioning method for commissioning a combustion control system of a steam/hot water boiler as disclosed herein provides a reliable formula based, iterative method to identify the coordinated air and fuel actuator positions. Compared to the typical trial and error method in conventional use, this formula based, iterative, assisted commissioning method provides improved precision of the coordinated fuel flow control and air flow control servo positions, significantly reduces the time required for commissioning, and reduces the tedious work and the dependency on the experience of the commissioning person associated with the conventional trial and error method of commissioning. Integrating the method of tuning the oxygen trim controller into the commissioning method as disclosed herein whereby the commissioning process and the tuning of the oxygen trim controller occur in a single stage, rather than in two distinct stages, simples the overall process and substantially reduces the time involved in completing the commissioning process and the tuning of the oxygen trim controller. It is to be understood that the method disclosed herein for tuning an oxygen trim controller during the commissioning process for a parallel positioning combustion control system may be used not only in connection with the particular commissioning method disclosed herein, but also in connection with the conventional trail and error method of commissioning or other methods of commissioning.

In the exemplary embodiment of the tuning method described hereinbefore, during the commissioning process, the fuel servo position is selected first at each selected rate and the air servo position is varied until the measured steady-state value of the excess oxygen content in the flue gas falls within a predefined range of a preselected excess oxygen target value associated with each respective selected firing rate, thereby establishing a coordinated set of an air servo position and a fuel servo position at each selected firing rate. In an alternate embodiment of the tuning method disclosed hereinbefore, during the commissioning process, the air servo position may be selected first at each selected firing rate and the fuel servo position varied until the measured steady-state value of the excess oxygen content in the flue gas falls within a predefined range of a preselected excess oxygen target value associated with each respective selected firing rate, thereby establishing a coordinated set of an air servo position and a fuel servo position at each selected firing rate. In either commissioning approach, excess oxygen content measurements as measured in the flue gas are taken while varying the servo position of one or the other of the air flow control device or the fuel flow control device and the excess oxygen content measurements are used in establishing a function modeling the relationship between excess oxygen contents and the selected firing rate.

Although the invention has been described with reference to the exemplary embodiments depicted, it will be recognized by those skilled in the art that various modifications may be made without departing from the spirit and scope of the invention. Those skilled in the art will also recognize the equivalents that may be substituted for elements or steps described with reference to the exemplary embodiments disclosed herein without departing from the scope of the invention. Therefore, it is intended that the present disclosure not be limited to the particular embodiment(s) disclosed as, but that the disclosure will include all embodiments falling within the scope of the appended claims.

The invention claimed is:

1. A method of tuning an oxygen trim controller during a commissioning process of a combustion control system for controlling operation of a boiler combustion system having a fuel flow control device operatively associated with a burner and an air flow control device operatively associated with the burner and discharging a flue gas, the method comprising:

(a) at a first selected firing rate selecting one of either the servo position of the fuel flow control device or the servo position of the air flow control associated with the selected firing rate point;

(b) defining an excess oxygen content target value for the selected firing rate point;

(c) varying the servo position of the other of the air flow control device or the fuel flow control device until a measured steady-state value of the excess oxygen content in the flue gas falls within a predefined range of a preselected excess oxygen target value associated with the first selected firing rate, thereby establishing a first coordinated set of a first air servo position and a first fuel servo position;

(d) measuring the excess oxygen content in the flue gas while varying the servo position during (c);

(e) establishing a transfer function model for the relationship between excess oxygen content and the first selected firing rate based on the measured excess oxygen contents and the corresponding servo positions from (d);

(f) repeating (a) through (e) for a plurality of selected firing rates;

(g) saving the transfer function models associated with each respective firing rate of the plurality of selected firing rates; and (h) calculating and saving controller parameters of the oxygen trim controller based on the transfer function models.

2. The method of tuning an oxygen trim controller as recited in claim 1 further comprising determining an average transfer function model over at least two of the plurality of the selected firing rates representative of the plurality of transfer function models associated with the at least two of the plurality of the selected firing rates.

3. The method of tuning an oxygen trim controller as recited in claim 2 further comprising using the average transfer function model to calculate a proportional parameter gain factor for the oxygen trim controller.

4. The method of tuning an oxygen trim controller as recited in claim 2 further comprising using the average transfer function model to calculate an integral parameter gain factor for the oxygen trim controller.

5. The method of tuning an oxygen trim controller as recited in claim 1 wherein the transfer function model has the form of $$G(s)=Ae^{-Bs}/(1+Cs);$$

where A is a gain factor constant, B is a time delay, C is a time constant, and s is a Laplace variable.

* * * * *